US008517211B2

(12) United States Patent
Brown et al.

(10) Patent No.: US 8,517,211 B2
(45) Date of Patent: Aug. 27, 2013

(54) COOLER/ICE CHEST VENTILATION METHOD AND APPARATUS

(76) Inventors: Chris Brown, Deming, WA (US); Chad Gibbon, Milnor, ND (US)

( * ) Notice: Subject to any disclaimer, the term of this patent is extended or adjusted under 35 U.S.C. 154(b) by 1353 days.

(21) Appl. No.: 11/871,995

(22) Filed: Oct. 13, 2007

(65) Prior Publication Data

US 2008/0029522 A1 Feb. 7, 2008

(51) Int. Cl.
*B65D 43/24* (2006.01)
*B65D 51/16* (2006.01)

(52) U.S. Cl.
USPC ..... 220/831; 220/366.1; 220/367.1; 16/85; 16/82; 292/288; 292/339

(58) Field of Classification Search
USPC ..... 220/831, 832, 366.1, 375, 521, 254, 220/9, 756; 292/262, 338, 339, 288, 1, 137, 292/163, DIG. 15; 16/82, 85, 86 R; 215/306
See application file for complete search history.

(56) References Cited

U.S. PATENT DOCUMENTS

| | | | | | |
|---|---|---|---|---|---|
| 834,489 | A | | 10/1906 | Purdum | |
| 1,232,851 | A | | 7/1917 | Sayers | |
| 1,334,908 | A | * | 3/1920 | Kinzel | 220/832 |
| 1,375,619 | A | | 4/1921 | Vaughn | |
| 1,945,375 | A | | 1/1934 | Pazandak | |
| 2,300,303 | A | * | 10/1942 | Morrison | 62/409 |
| 2,339,933 | A | * | 1/1944 | Lilienfield | 217/61 |
| 2,618,497 | A | | 11/1952 | Gardels | |
| 2,879,915 | A | | 3/1959 | Medor | |
| 3,026,825 | A | * | 3/1962 | Kidwell | 109/63.5 |
| 3,274,987 | A | * | 9/1966 | Hastings, Jr. | 126/25 R |
| 3,735,890 | A | * | 5/1973 | Archibald | 217/61 |
| 3,834,745 | A | * | 9/1974 | Coates | 292/339 |
| 4,213,310 | A | | 7/1980 | Buss | |
| D269,398 | S | | 6/1983 | Ruxton | |
| 4,584,984 | A | * | 4/1986 | Croft | 126/25 R |
| D307,998 | S | | 5/1990 | Costello et al. | |
| D309,239 | S | | 7/1990 | Deines et al. | |
| D309,396 | S | | 7/1990 | Lundblade et al. | |
| 4,979,634 | A | | 12/1990 | Begley | |
| 5,064,088 | A | | 11/1991 | Steffes | |
| D325,323 | S | | 4/1992 | Kahl | |
| D330,329 | S | | 10/1992 | Brightbill | |
| 5,213,299 | A | | 5/1993 | Henry | |
| 5,319,937 | A | | 6/1994 | Fritsch et al. | |
| D349,007 | S | | 7/1994 | Costello | |
| D355,766 | S | | 2/1995 | Miller | |
| 5,713,468 | A | * | 2/1998 | Streichan | 206/372 |
| 5,964,365 | A | | 10/1999 | Peeples et al. | |
| 6,158,233 | A | * | 12/2000 | Cohen et al. | 62/268 |
| 6,164,484 | A | | 12/2000 | Fiore et al. | |
| 6,212,901 | B1 | | 4/2001 | Pint et al. | |
| 6,357,252 | B1 | * | 3/2002 | Rand | 62/457.7 |

(Continued)

*Primary Examiner* — Anthony Stashick
*Assistant Examiner* — James N Smalley
(74) *Attorney, Agent, or Firm* — Matthew Jellett

(57) ABSTRACT

A ventilation apparatus for a cooler combination. The ventilation apparatus has a first cooler engageable portion and a second cooler engageable portion. Each portion is configured to interoperate with either a first cooler location or a second cooler location. A body section connects the first and second cooler engageable portions together. The cooler has four perimeter walls and a lid. The ventilation apparatus is positioned at the first cooler location and second cooler locations which are located on the lid and the perimeter walls. The apparatus maintains a ventilation space between the lid and the cooler perimeter walls promoting ventilation of the interior space of the cooler.

12 Claims, 14 Drawing Sheets

(56) References Cited

U.S. PATENT DOCUMENTS

| | | | | |
|---|---|---|---|---|
| D527,226 | S | 8/2006 | Maldonado | |
| D528,368 | S | 9/2006 | Maldonado | |
| 7,140,507 | B2 | 11/2006 | Maldonado et al. | |
| 2002/0125160 | A1 * | 9/2002 | Itzkovitch | 206/373 |
| 2004/0055220 | A1 * | 3/2004 | Lohman | 49/322 |

* cited by examiner

COOLER/ICE CHEST VENTILATION METHOD AND APPARATUS

RELATED APPLICATIONS

This application claims priority benefit of U.S. Ser. No. 60/936,928, filed Jun. 25, 2007.

DESCRIPTION OF THE PREFERRED EMBODIMENTS

Figure 1:
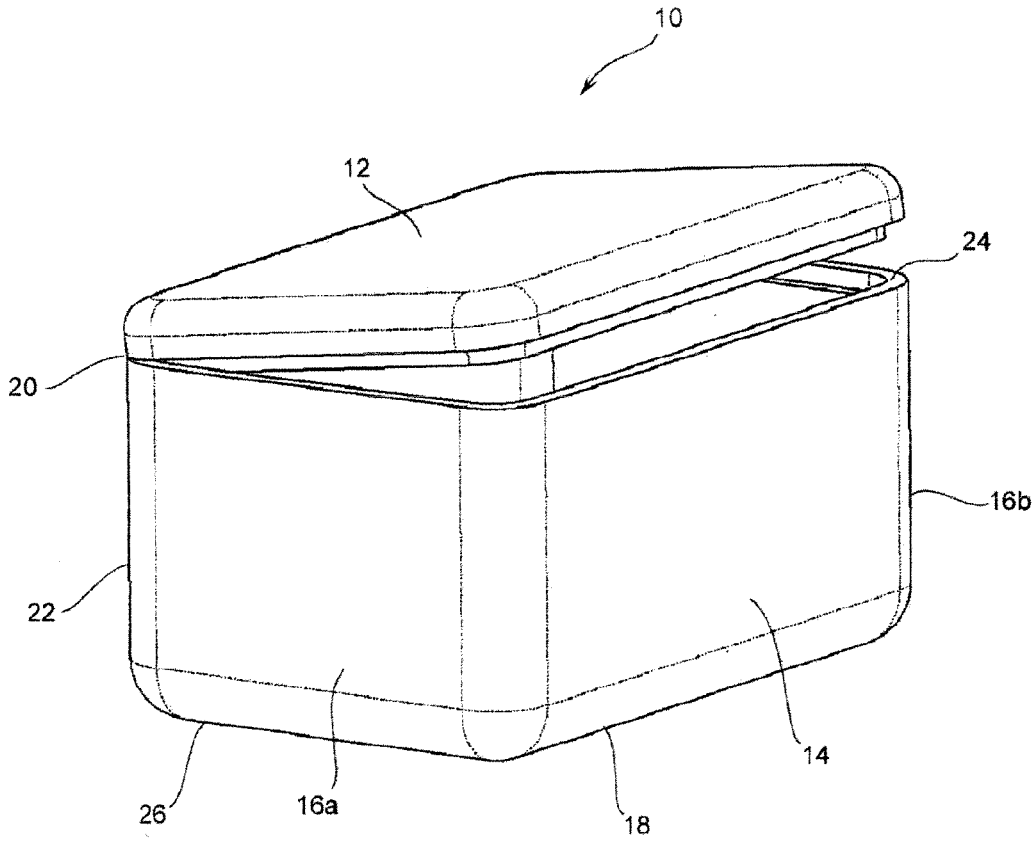
FIG. 1 is a perspective view of an ice chest.

Generally speaking, referring to FIG. 1, a standard cooler 10 is shown, the cooler being used to maintain warm and cold temperatures of food items when individuals are fishing, camping, or traveling. The individuals usually do not have the use of an electric refrigerator or heater to maintain the proper food temperature for food items. These coolers 10 are usually insulated having a wall with an inner cavity which may be maintained at a vacuum state so as not to allow heat gain or loss from the inner portion to the outer portion of the chest.

The coolers 10 usually have a top lid 12, a plurality of sidewalls including a front perimeter wall 14, equal but opposite parallel side perimeter walls 16A & 16B, a back perimeter wall 22, a bottom wall 18 connected to the bottom edge 26 of the perimeter walls, and a top lid 12 which is interoperable with the top edge 24 of the perimeter walls to provide access to the cooler when open and to create a seal between the top lid and the side perimeter walls when the lid is closed.

The cooler 10 will be filled with ice to maintain a cold temperature. Over a period of time, the temperature in the cooler will increase, melting the ice. Water vapor remains in the cooler even after the ice has been drained from the cooler.

After the cooler has been stored, the water vapor and/or water film within the cooler 10 will most times still remain. If that is the case, bacteria will begin to build within the cooler 10 and produce odors requiring maintenance requiring the ice chest 10 to be discarded.

Figure 2:
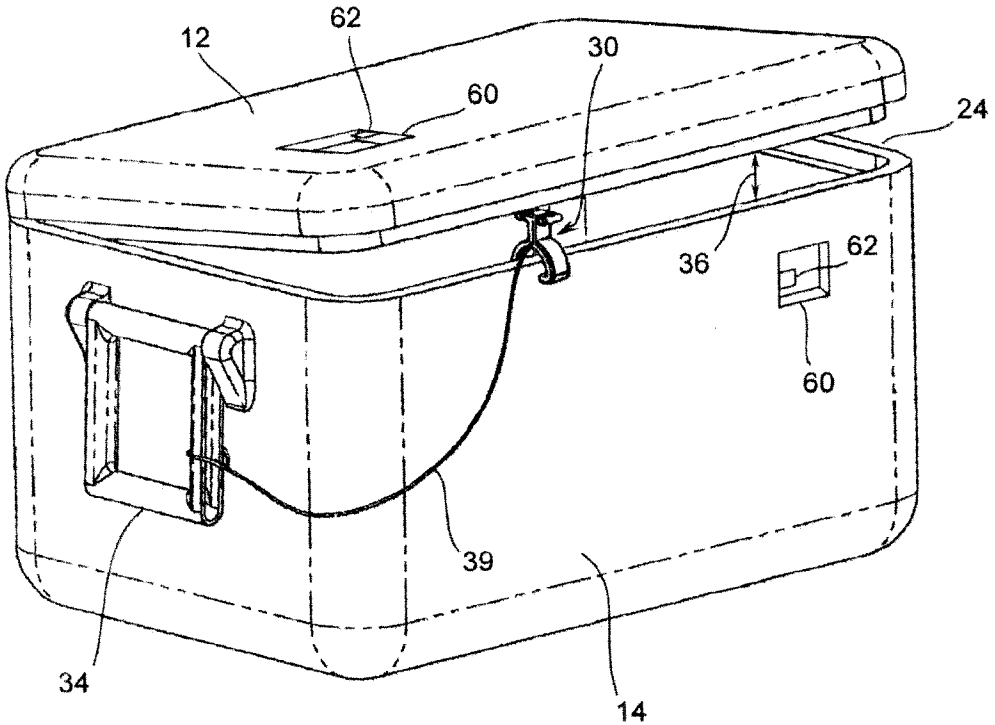
FIG. 2 is a perspective view of an ice chest with a first embodiment of the ventilation apparatus.

Referring to FIG. 2, in order to promote evaporation, a cooler combination utilizing a ventilation apparatus 38 is provided. The ventilation apparatus 38 maintains a gap between the top lid and the top wall of the cooler 10. This open position of the cooler lid enables the evaporation to take place when the cooler 10 is not being used. Airflow between the interior region of the cooler and the exterior region or outer area of the cooler is promoted because of the opening. The airflow may be a natural current, or may be promoted by mechanical means such as a small fan. The ventilation apparatus takes many forms, some of which are shown below in this particular application.

A discussion of various alternative embodiments of the ventilation apparatus will be provided. It will be readily conceived that alternative additional embodiments to maintain the ventilation between the interior space and the exterior space of the cooler are envisioned.

Still referring to FIG. 2, in a first embodiment, the cooler combination utilizing the ventilation apparatus 38 is located at a second and a third pair of cooler locations, these locations may be on or near the top edge 24 of the front perimeter wall 14, or they may be located on the top lid 12. Also, in this embodiment, the ventilation apparatus 38 supports the top lid at a first cooler location. This first location in alternative embodiments may be on the one of the lid edges, the top, the side, or the bottom of the lid. Also, if the second and third cooler locations are on the lid, then the first cooler location may be located somewhere on the perimeter wall.

The ventilation apparatus 38 can also be mounted on the sidewalls 16A or 16B depending on the user's desire to maintain a larger or smaller ventilation space 36 to promote a larger or smaller volume of air flow. For example, if the ventilation apparatus 38 is positioned towards the hinge edge 20 (as seen in FIG. 1), the angle of inclination between the top lid 12 and the top edge 24 of the perimeter walls will increase, thus increasing the cross sectional area through which the air can flow.

Still referring to FIG. 2, the ventilation apparatus 38 is connected or tethered to the cooler 10 by the use of a connection cord 39. When not in use, the ventilation apparatus 38 may be maintained on the cooler near the side handle 34 or other pre-determined location, such as an inset pocket 60 located on the top lid or one of the perimeter side walls.

Figure 3:
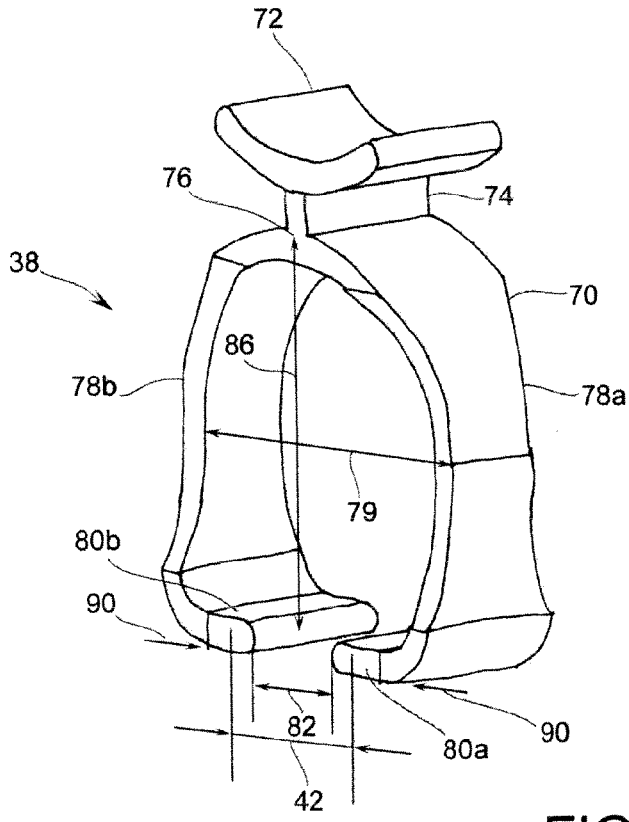
FIG. 3 is a perspective detail view of a first embodiment of the ventilation apparatus.
Figure 4:
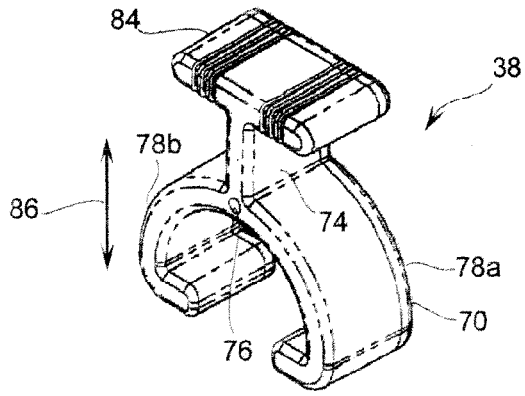
FIG. 4 is a perspective detail view of the second embodiment of the ventilation apparatus.

Referring to FIGS. 3 & 4 in the first embodiment, a more detailed discussion of the ventilation apparatus 38 will now be provided. The ventilation apparatus 38 is defined by cooler engageable portions. For example, referring to FIG. 3, the ventilation apparatus 38 in this particular embodiment has a first cooler engageable portion which is a lid support seat 72, here arranged in a semi-cylindrical configuration. At the midpoint of the arc of the lid support seat 72, a first body section which in this embodiment is configured as a rectilinear support wall 74 is arranged to connect the lid support seat 72 to the clip arms discussed below. The clip arms act as the second and third cooler engageable portions of this first embodiment of the ventilation apparatus.

Figure 7:
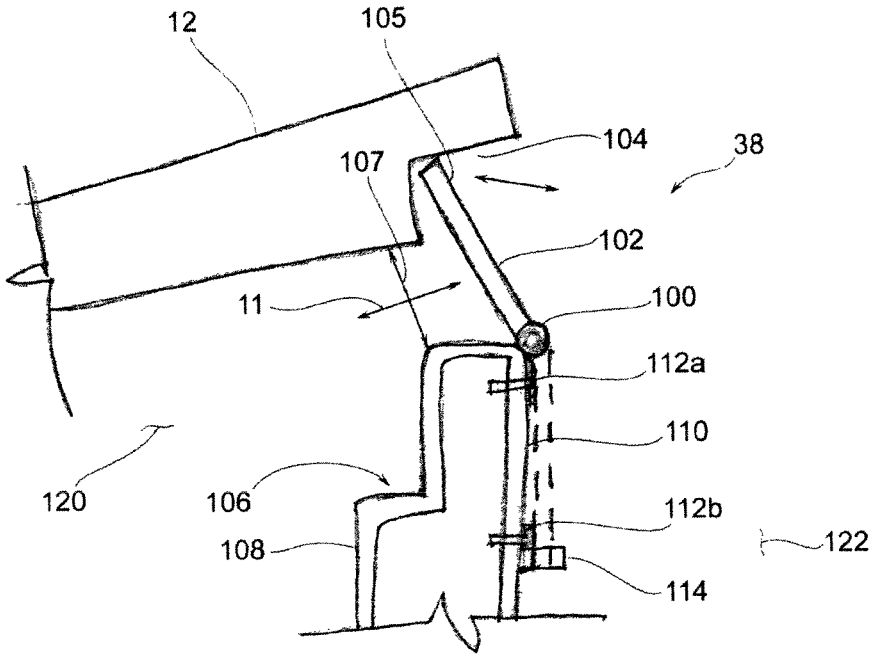
FIG. 7 is a cross-sectional detail view of a fourth embodiment of the ventilation apparatus.

This particular ventilation apparatus 38 is configured to impinge on the inner and outer walls of the perimeter cooler walls 14 to 16B at the second and third cooler locations, and also extend over in some instances (as seen in FIG. 7) the lid wall seat 106, so that the ventilation apparatus can fit onto multiple widths of various cooler wall designs.

This somewhat horseshoe-configured wall mounting ventilation apparatus 70 has extending from the bottom edge of the neck wall 74, a first arcuate clip arm 78A and a second arcuate clip arm 78B. These clip arms have a vertical height 86 between the bottom edge of the rectilinear support wall 74 and the top edge of the grip foot 80A and 80B, to extend onto the perimeter width 79 enabling the arms to extend out beyond the inner and outer edges of the various perimeter walls having a range of cross-sectional sizes.

Still referring to FIG. 3, the perimeter wall width 42 is usually going to be a greater distance than the clip gap 82 between the grip foots 80A and 80B located at the bottom edge of the arcuately aligned clip arms 78A and 78B. The grip feet transition from the vertical to the horizontal through a curvilinear corner.

Briefly discussing the materials of the ventilation apparatus 38, the apparatus can be constructed of various materials including a polymer/plastic, metallic material, ceramic material, wood, or composite material. The apparatus may be constructed of an inner core with an outer layer, the inner core made of one of the above materials, with an outer layer being constructed of a clear polyvinyl chloride, a clear silicone, thermal plastic elastomer, or a butyl rubber construction. The first embodiment, with the first grip foot 80A and second grip foot 80B, can have the construction of the grip feet made of a gripping material such as the above-mentioned outer materials, including a clear polyvinyl chloride, rubber, or silicone.

In use, the first and second lower grip feet 80A and 80B, are stretched a clip gap distance 82 outwards which must be greater than the perimeter wall width 42 of the subject cooler 10. The ventilation apparatus 38 is placed over the top edge 24 of the perimeter wall as seen in FIG. 2.

The wall mounting ventilation apparatus with the horseshoe configuration 70, will maintain its position on the wall by exerting a pinching force 90 against the inner and outer wall faces of the cooler wall. This pinching force is the lateral component of a spring constant (K) of the first arcuate clip arm 78A and the second arcuate arm 78B each elastically pressuring to return to their original resting position. The elasticity ranges of each of the above materials will vary depending on the type of material used. These elasticity ranges for the materials are well known within the art and are incorporated herein by reference.

Referring to FIG. 4, a second embodiment of the wall mounting ventilation apparatus 70 is shown where the vertical height 86 of the clip arms 78A and 78B is significantly smaller, with an increased vertical height length of the neck wall 74. Also, the lid support seat 84 is arranged in a flat wall configuration.

In an alternative embodiment of the second embodiment, at the origin location 76 of the arcuately aligned clip arms 78A and 78B, in lieu of utilizing the elasticity component of the member arms, a spring-loaded hinge 77 is aligned along the base portion of the support wall, which enables the user to stretch the clip gap 82 between the grip feet 80A and 80B and enabling the ventilation apparatus 38 to be mounted over the top edge 24 of the cooler 10 (FIG. 2).

Figure 5:
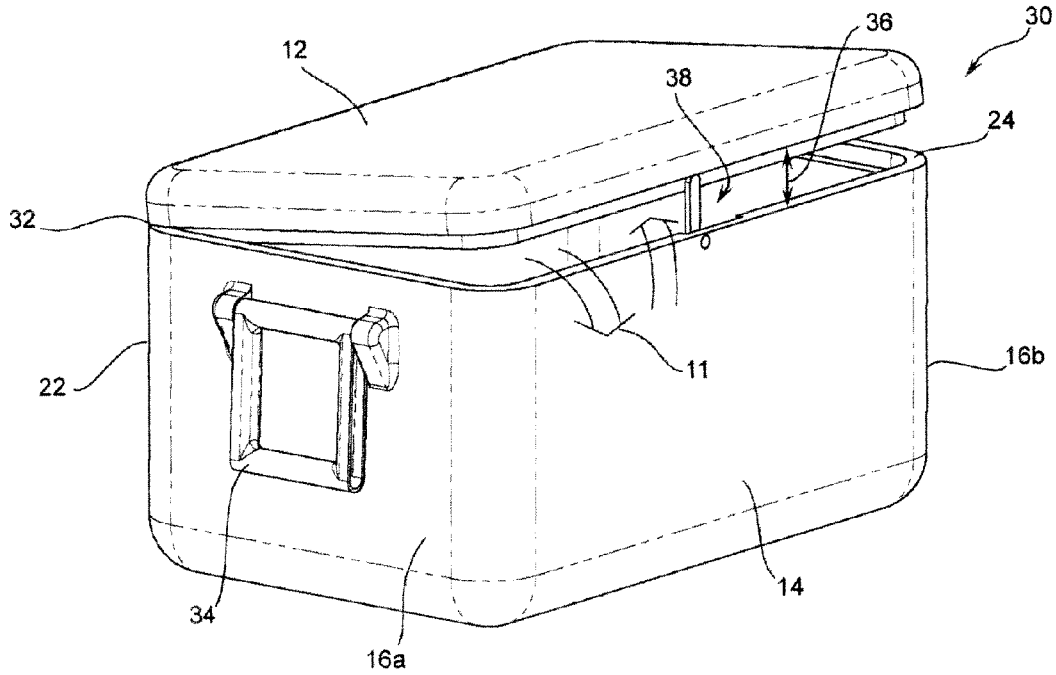
FIG. 5 is a perspective view of an ice chest in combination with a third embodiment of the ventilation apparatus.

Referring to FIG. 5, a third embodiment of the cooler combination is provided. In this particular embodiment, the ventilation apparatus 38 is arranged on the inside face of the front perimeter wall 14. Ventilation airflow 11 is allowed to enter into and exit the ventilation space 36 of the cooler ventilation combination 30. The cooler in some embodiments has one or two side handles 34 which are arranged on both the first and second side walls 16A and 16B.

Figure 6:
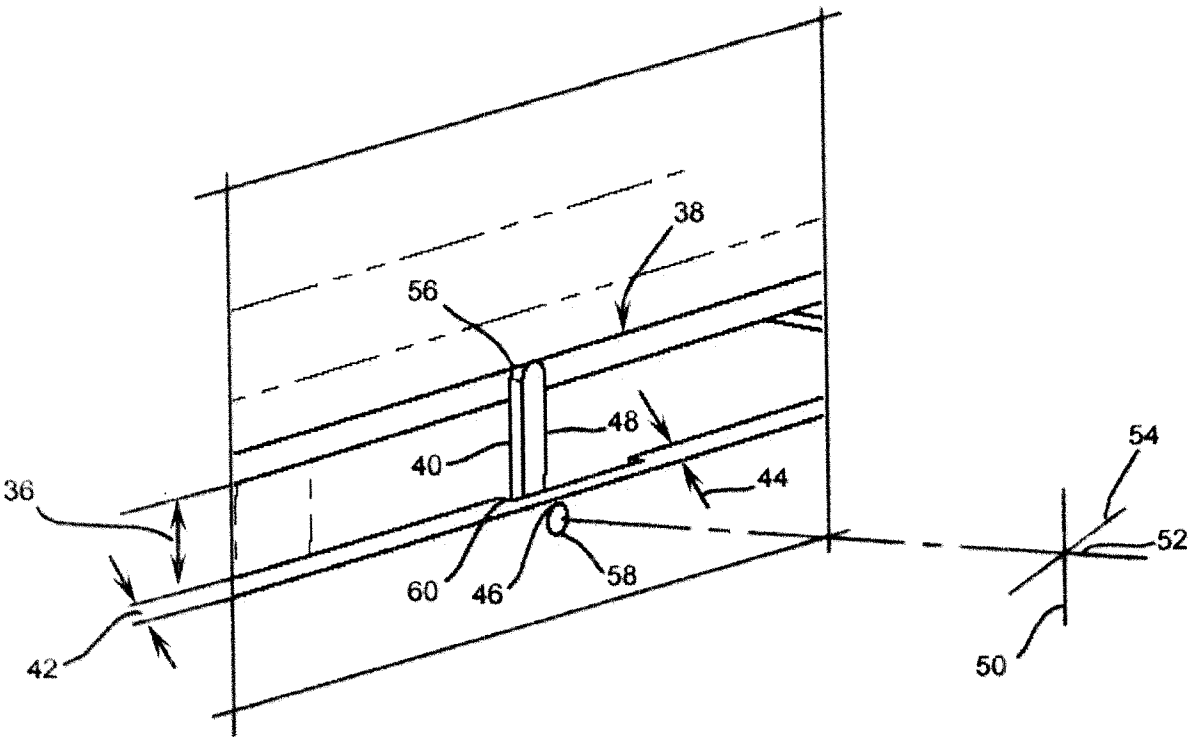
FIG. 6 is a perspective detail view of a third embodiment of the ventilation apparatus.

Referring to FIG. 6, a detailed discussion of the third alternative embodiment of the ventilation apparatus 38 will be provided. Here a first body section acting as a hinged prop arm 40 is located either on the inside face of the cooler perimeter walls or seated within a longitudinally aligned inset seat 46. The arm has a first cooler engageable portion (interacting with the lid in this embodiment), and a second cooler engageable portion (interacting with the perimeter wall in this embodiment). The first and second portions could be switched to provide for opposite intereactions with the lid and perimeter walls.

For discussion purposes as related to the arrangement of the cooler, a longitudinal axis 54 runs substantially parallel with the front perimeter wall 14, a transverse axis 52 runs substantially parallel with the side walls 16A and 16B, and a vertical axis 50 runs perpendicular to the longitudinal and transverse axes. In this particular embodiment, a second cooler location has a hinge 58 which is arranged along the transverse axis 52, enabling the hinged prop arm 40 to actuate from the open to close position, or in other words, from a non-engaged position to a propped ventilation space opening position.

The hinged prop arm 40 actuates radially about the transverse axis of the hinge 58. In its seated position, the arm 40 is seated within the longitudinally aligned seat 46 which is inset within the perimeter wall width 42 and inset seat distance 44. This inset seat distance 44 is substantially the same as the transverse width of the hinged prop arm 40, providing a built-in smooth finish profile of the hinged arm 40 within the wall width 42. With the arm 40 in its open position, the arm maintains support of the top lid 12 at a first cooler location. Thus enabling the ventilation space 36 to allow the ventilation airflow 11, providing evaporation of the moisture content within the interior space of the cooler. Optionally, the hinge 50 may have a spring-loaded component with the loading set for maintaining a current open a close position of the hinge to prop arm.

A fourth alternative embodiment, as seen in FIG. 7, is provided. Here the ventilation apparatus 38 has a first body section which is a latch arm 102 arranged on the outside face of the perimeter wall 108. The first cooler engageable portion is the free end of the latch arm which sits within the lid 12 has a lid seat 104 acting as the first cooler location. The latch arm 102 has a second cooler engageable end or portion which is connected at the second cooler location. The second cooler location being a side wall hinge 100 arranged at the outer corner edge of the perimeter wall 108. The latch arm 102 actuates radially about the central axis of the side wall hinge 100 from a supported position to a non-supported or closed position.

The closed position as seen in hatched lines has the latch arm held in place by a latch bottom stay 114. The latch arm 102 and the hinge 100 are maintained in position by an arm connection plate 110. The arm connection plate 110 may be integrated into the outer face of the perimeter wall 108 or connected to the outer face of the perimeter wall by upper and lower screw attachments 112A and 112B.

When used, the latch arm 102 maintains the ventilation space distance 107 by supporting the lid at the first cooler location (the lid seat location 104). The space 107 allows natural or mechanical airflow 11 to promote evaporation and maintain a dry interior region 120 of the cooler.

Figure 8:
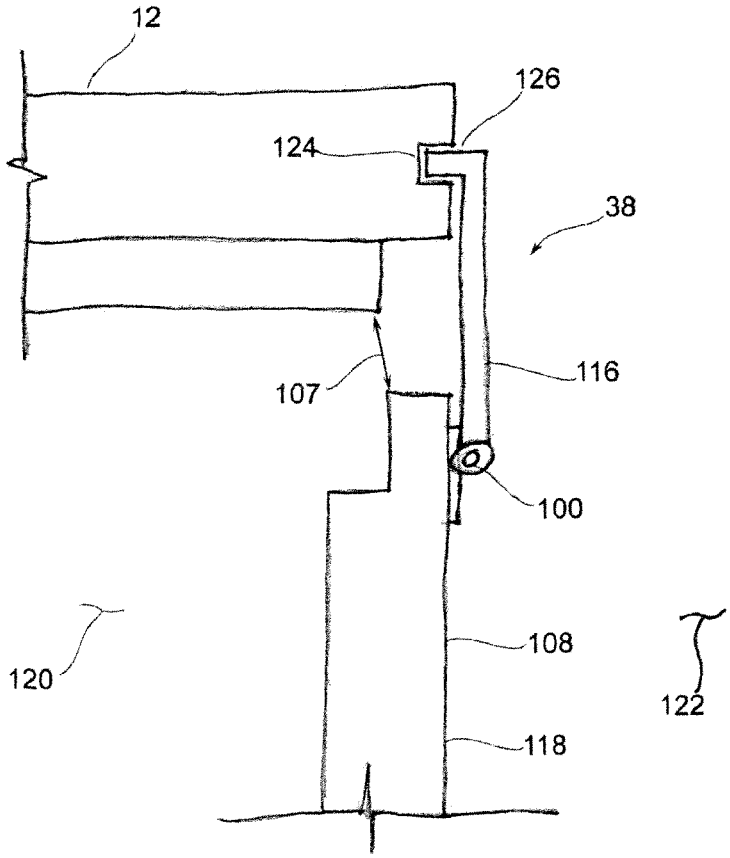
FIG. 8 is a cross-sectional detail view of a fifth embodiment of the ventilation apparatus.

Referring to FIG. 8, a fifth alternative embodiment is provided. The ventilation apparatus 38 has a first body section which is a latch arm similar to the previously discussed latch arm 102 in FIG. 7, and with the second cooler location being the spring-loaded hinge attached to the outside face 118 of the perimeter wall 108 (the second cooler engageable portion of the latch arm is the end of the latch arm connected to the hinge). The latch arm 116 has a first cooler engageable portion which is a male latch protrusion 126 arranged to interoperate with a first cooler location which is a pre-formed female latch seat 124 formed in the top lid 12. In this particular embodiment, the latch arm can be arranged on the front perimeter wall 14, or side perimeter wall's 16A or 16B, FIG. 5, as desired. The above fifth embodiment may or may not utilize a spring-loaded hinge.

Figure 9:
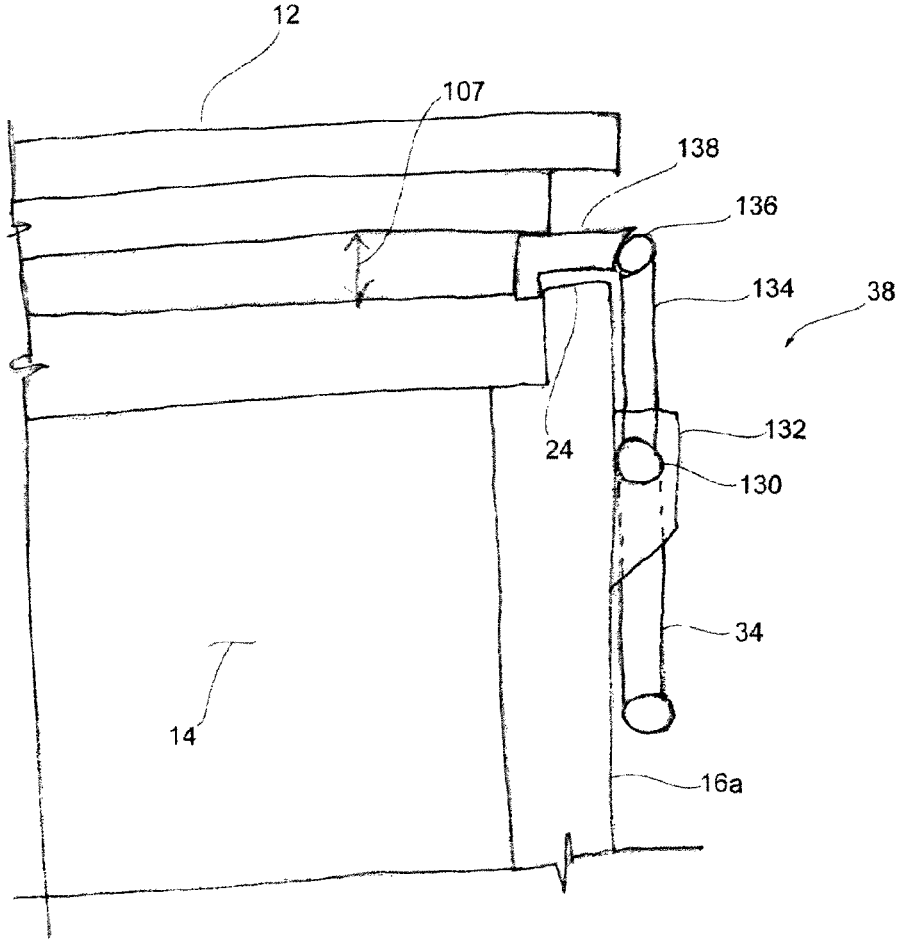
FIG. 9 is a cross-sectional detail view of a sixth embodiment of the ventilation apparatus.

Referring to FIG. 9, a sixth embodiment of the ventilation apparatus 38 is provided. As discussed above, side handles 34 are usually arranged on the side walls 16A or 16B of the cooler or even on the front perimeter wall 14 as seen in FIG. 5. In this embodiment, the ventilation apparatus 38 is designed to be integrated in various forms with the side or front handle 34 of the cooler 10.

The side handle 34 are connected to the handle hinge 130. The handle hinge 130 is arranged between two transversely aligned handle hinge mounts 132. The ventilation apparatus 38 is arranged between the arms of the side handle 34 on the handle hinge 130.

The first body section is divided into a first latch segment 134 which extends from the handle hinge 130 and may be radially rotated about the handle hinge 130. The first latch segment 134 terminates at an intermediate hinge segment 136. An intermediate hinge segment 136 provides for a connection of the second half of the first body section, that being a second latch segment 138 radially rotatable about the interior intermediate hinge segment 106 and seatable over the top edge of the perimeter wall 24.

A ventilation space 107 is maintained between the bottom edge of the top lid 12 and the top edge 24 of the perimeter wall when the second latch segment 138 is maintained between the lid and the edge to provide evaporation and airflow into and out of the cooler.

Figure 10:
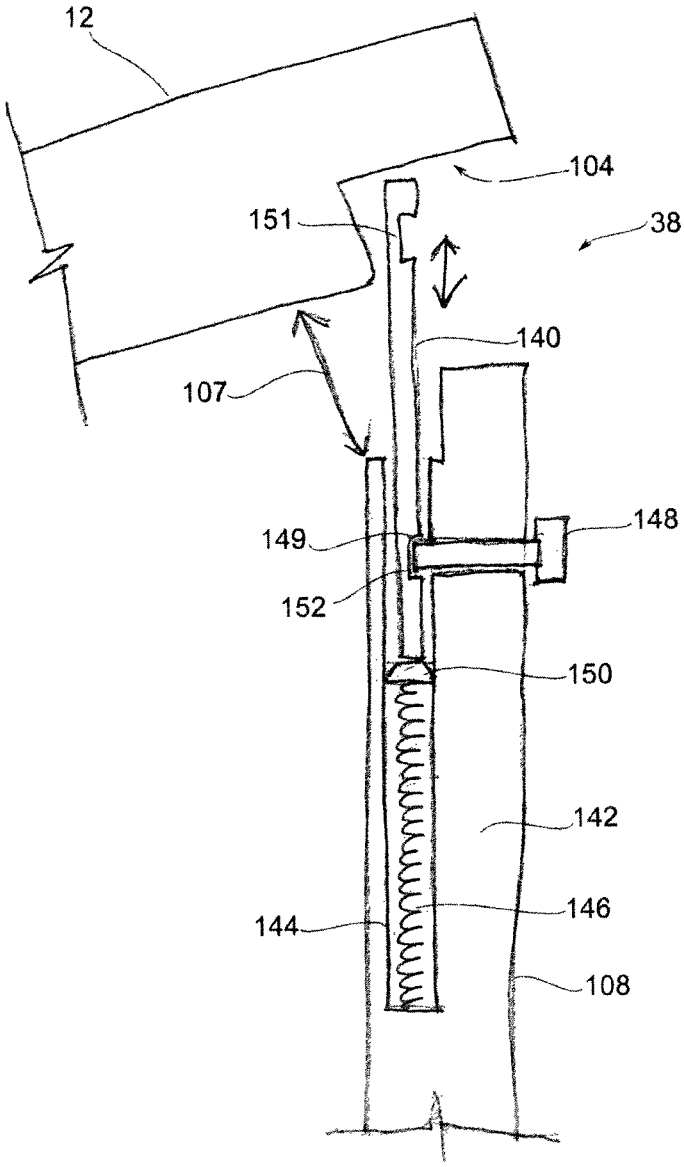
FIG. 10 is a cross-sectional detail view of a seventh embodiment of the ventilation apparatus.

A seventh embodiment is provided as seen in FIG. 10. Here the ventilation apparatus 38 utilizes a spring-loaded shaft component maintained within the interior region 142 of the wall 108. A locking pin 148 is engageable with a lower shaft notch 152 and an upper shaft notch 151. The notches are arranged along the bottom and top portions respectively of the vertically aligned shaft 140.

The vertically aligned shaft 140, is positioned within the interior shaft sleeve 144, and is maintained in both a supporting position and a non-supporting position. In the supporting position, the vertically aligned shaft 140 is extended upwards to maintain the lid 12 at its' open position to maintain the ventilation space 107 and airflow 11.

The locking pin 148 is transversely aligned perpendicular to the vertically aligned shaft 140 and a tension spring 153 provides for inwards lateral tension of the locking pin 148 to actuate against the shaft notch 152. Alternatively, although not shown, a compression spring arranged on the opposite side of the tension spring may be provided to compress the locking pin 148 against the shaft 140. The locking pin has a through hole, through which the shaft 140 is threaded for interoperation with the locking pin.

As indicated above, the vertically aligned shaft 140 is threaded through a locking pin opening 149. When disengaged from the upper shaft notch 151, the vertically compressed spring shaft 146 forces the shaft 140 upwards. Once released, the locking pin 148 is pulled back towards the interior portion of the perimeter wall, asserting a transverse force against the outer face of the shaft 140.

When the locking pin 148 engages the lower shaft notch 152, it locks the shaft in place, and the top lid 12 can be supported by the vertically aligned shaft 140 to maintain the ventilation space distance 107, thus promoting ventilation airflow and evaporation.

Figure 11:
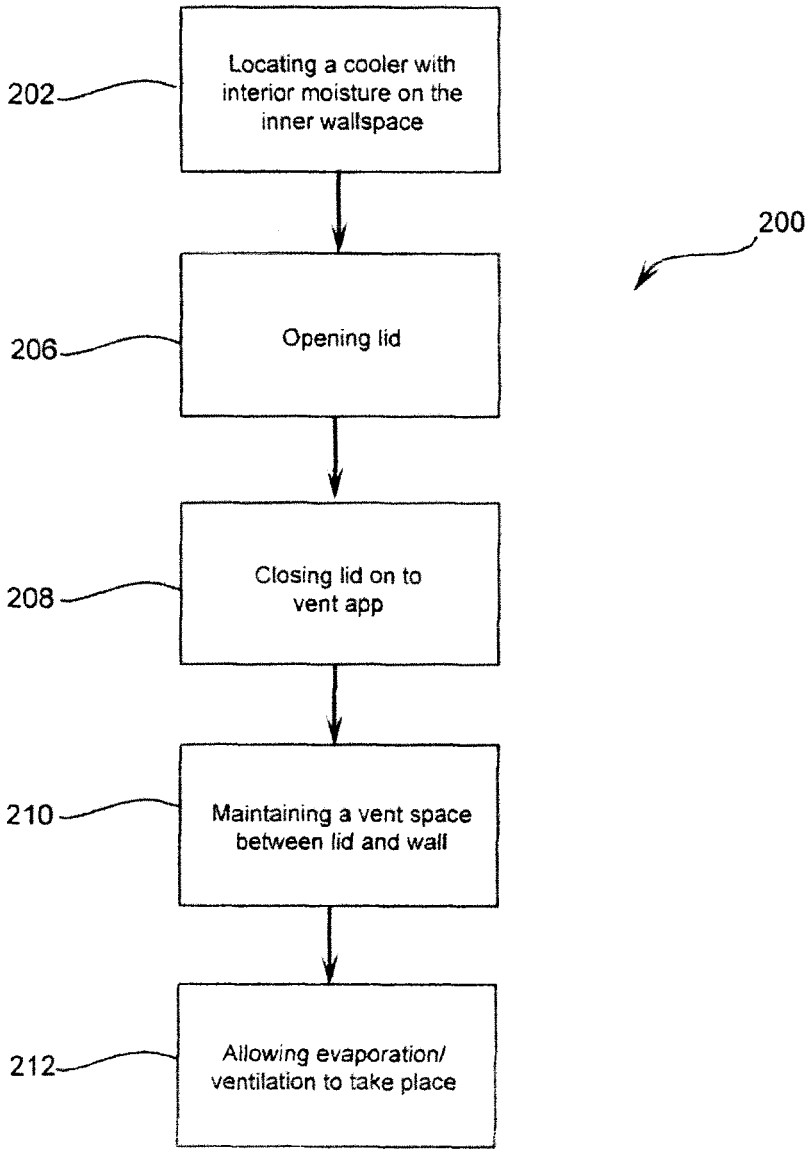
FIG. 11 is a flowchart diagram of a method of insulating a cooler.

A method of ventilating a cooler 200 will now be provided as seen in FIG. 11. After use, the cooler as previously discussed, will usually have moisture maintained in some form within the inner region 120, FIG. 8, of the cooler 10. The user will at step 202, locate the cooler with the interior moisture on the inner region or space of the cooler.

The user will at step 204 open the lid of the cooler and at step 206 arrange a ventilation apparatus between the top lid and perimeter wall. At this point, the user will close the lid at step 208 on to the ventilation apparatus. The ventilation apparatus will, at step 210 maintain a ventilation space between the lid and the wall. The ventilation space at step 212 will allow evaporation and ventilation to take place between the interior region 120 and the exterior region 122 of the cooler.

Figure 12:
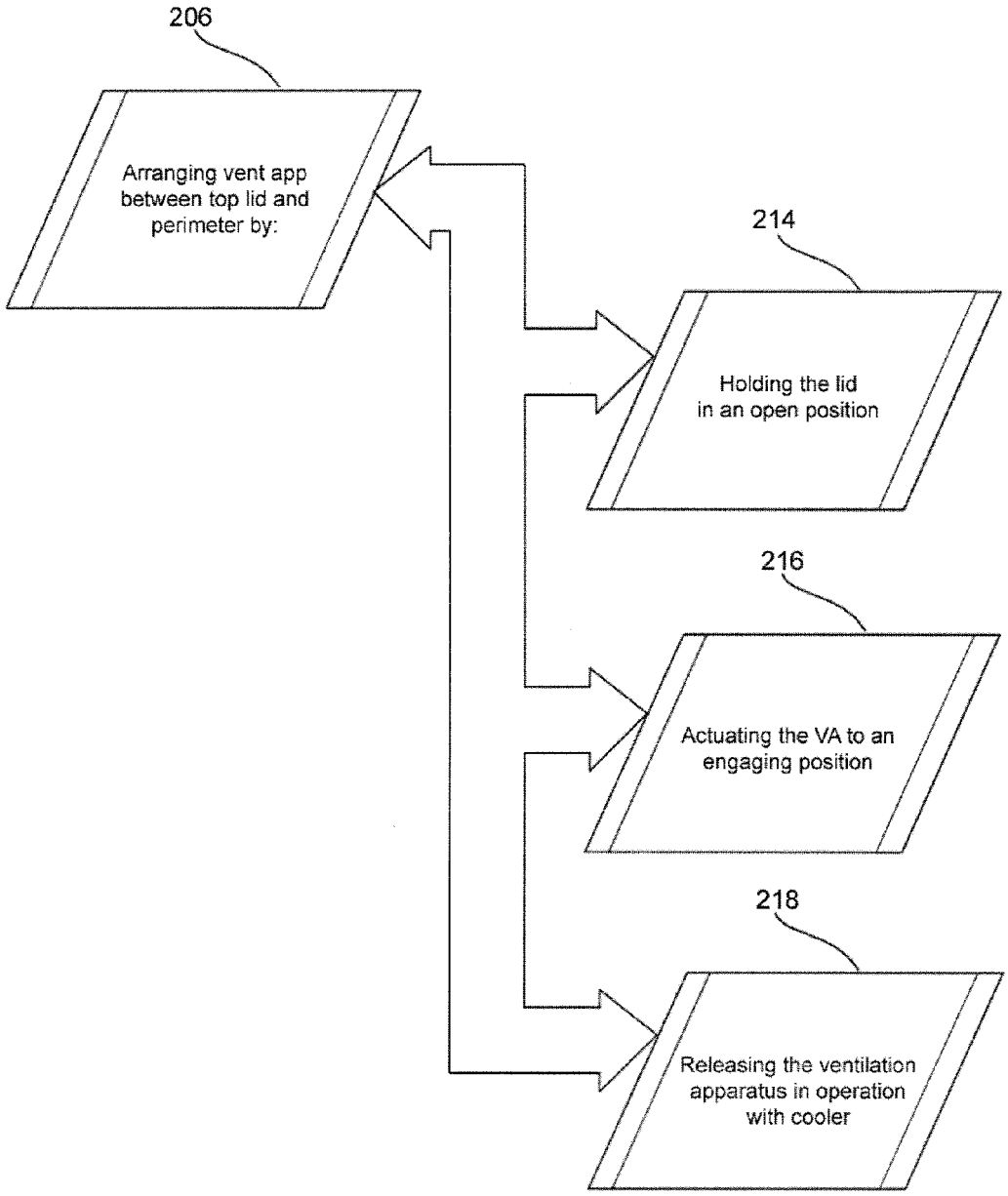
FIG. 12 is a flowchart diagram of a method for arranging the ventilation apparatus between the top lid and the perimeter wall.

Referring to FIG. 12, the step of arranging a ventilation apparatus between the top lid and the perimeter wall at step 206 further includes: holding the lid in an open position at step 214; actuating the ventilation apparatus to an engaging position at step 216, and releasing the ventilation apparatus in operation with the cooler at step 218.

Figure 13:
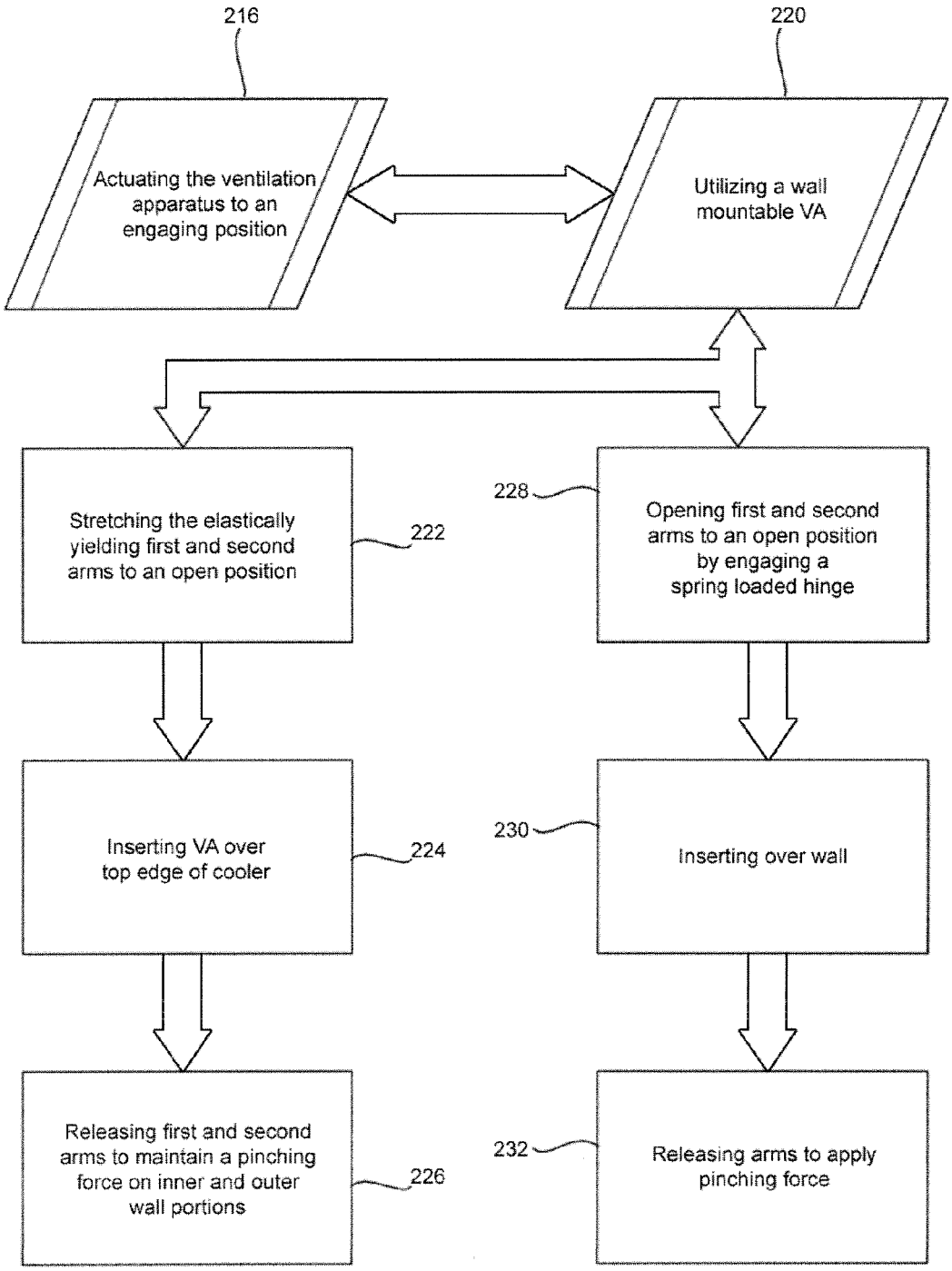
FIG. 13 is a flowchart diagram of the method for actuating the ventilation apparatus to an engaging position.

Referring to FIG. 13, the step of actuating the ventilation apparatus to an engaging position at step 216 includes in the alternative, the following steps depending on the particular embodiment utilized such as the below options.

The step of actuating the ventilation apparatus to an engaging position at step 216 includes utilizing a wall mountable ventilation apparatus at step 220 and stretching the first arcuate arm and second arcuate arm to an open position at step 222, inserting the wall mounting ventilation apparatus over the top edge 24 of the cooler, and releasing the first and second arm to maintain a pitching force 90, FIG. 3, on the inner and outer wall portions of the permanent wall at step 226.

The step of actuating the ventilation apparatus to an engaging position at step 216 may also include utilizing a wall mountable ventilation apparatus and opening the first and second arcuate arms to an open position by engaging the spring-loaded Apex hinge 77 at step 228, inserting the wall mounting ventilation apparatus over the top edge 24 of the cooler at step 230, and releasing the first and second arcuate arms at step 232 which maintain a pinching force 90 against the outer portions of the wall applied from the spring-loaded hinge 77 at the apex of the arms.

Figure 14:
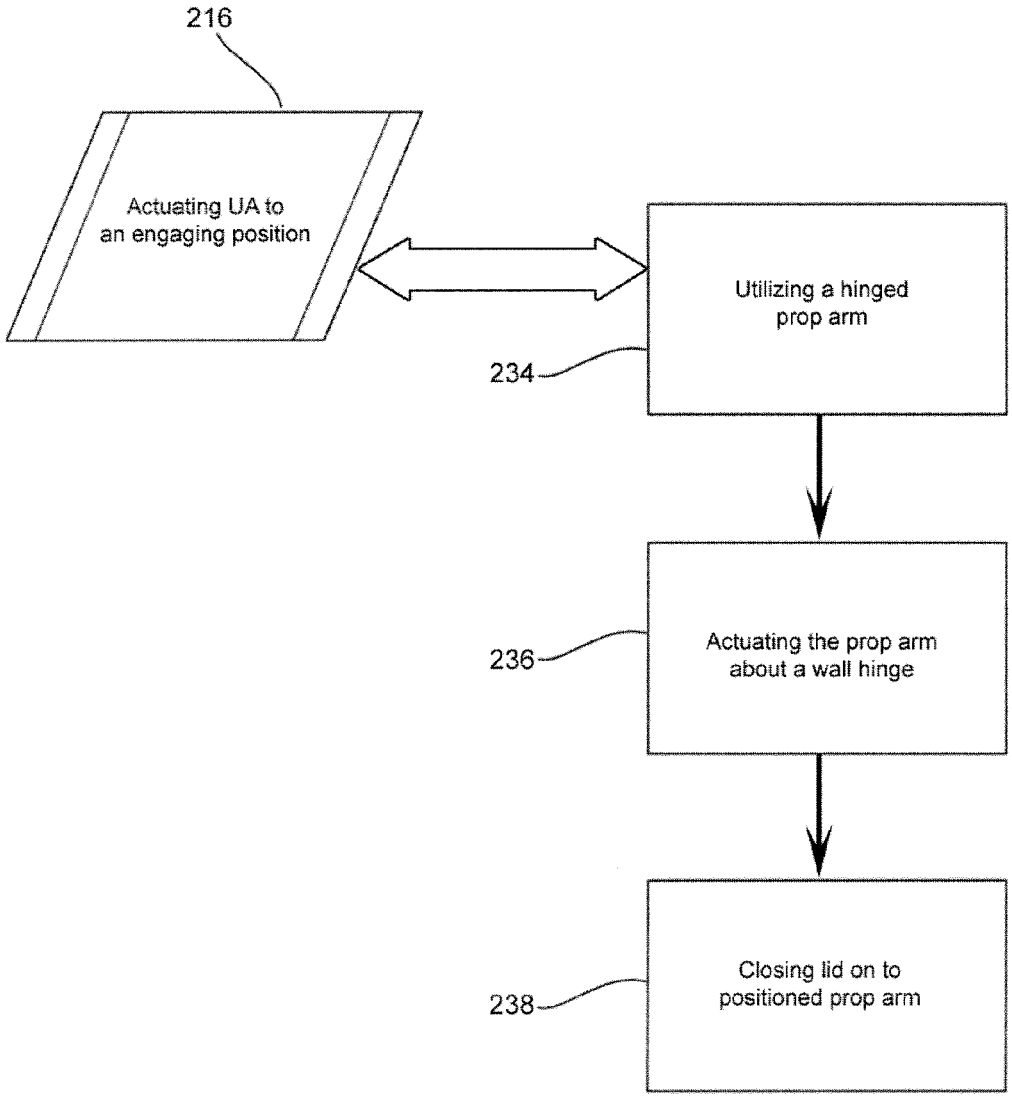
FIG. 14 is a flowchart diagram of an alternative embodiment for a method of actuating the ventilation apparatus to an engaging position.

Referring to FIG. 14, the step of actuating the ventilation apparatus to an engaging position at step 216 may also include utilizing a hinged prop arm 40, FIG. 6, at step 234, by actuating the hinged arm about a wall aligned hinge at step 236, closing the lid onto the prop arm at step 238, to maintain the open position. The wall connected hinge is aligned either parallel with the wall or perpendicular to the wall. The hinge may also be on the lid portion, with the prop arm connected to and interoperating with the wall portion.

Figure 15:
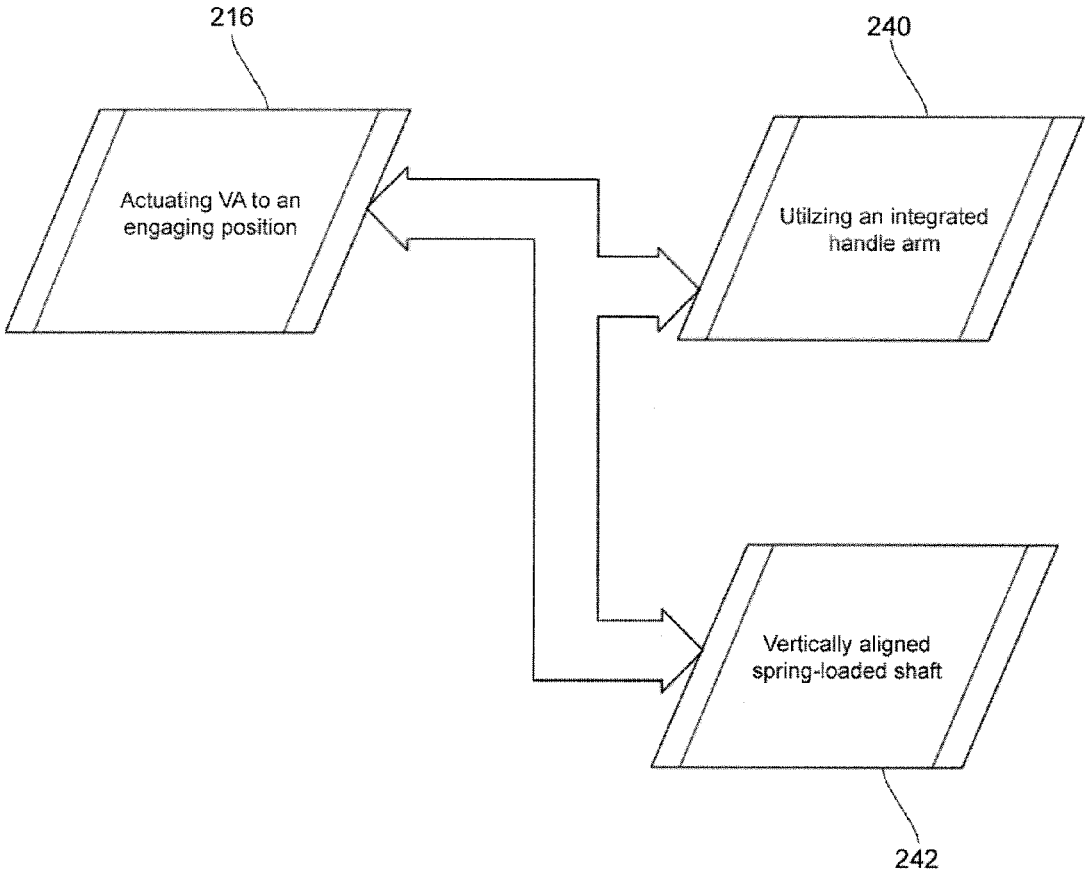
FIG. 15 is a flowchart diagram of an alternative embodiment of the method of actuating a ventilation apparatus to an engaging position.

Referring to FIG. 15, the step of actuating the ventilation apparatus to an engaging position at step 216 may also include utilizing an integrated handle arm at step 240, which provides a first latch segment 134, (FIG. 9), interoperating with an intermediate hinge segment 136, cooperating with a second latch segment 138. The second latch segment 138 is engageable over the top edge of the perimeter wall, in this embodiment a side wall 16A, to maintain the ventilation area 107 between the bottom edge of the top lid and the top edge of the perimeter wall.

Still referring to FIG. 15, the step of actuating the ventilation apparatus to an engaging position at step 216 may also include utilizing a vertically aligned spring-loaded shaft at step 242, the shaft operable from a closed position to an open position, where releasing the spring-loaded shaft from the closed position moves the shaft to the open position, so the shaft can engage the lid and provide support to maintain the lid in an open position, creating the ventilation space 107.

While the present invention is illustrated by description of several embodiments and while the illustrative embodiments are described in detail, it is not the intention of the applicants to restrict or in any way limit the scope of the appended claims to such detail. After reading the above disclosure it is likely that additional advantages and modifications within the scope of the appended claims would readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

We claim:

1. A method of ventilating a cooler having interior moisture, the cooler including a perimeter wall having an inner wall portion, an outer wall portion and a top edge, where the top edge has a width, the cooler also including a lid, said method comprising:

opening the lid of the cooler;

stretching first and second elastically yielding arms of a ventilation apparatus from a first position to a second position, wherein the first position defines a first gap between the first and second arms and the second position defines a second gap between the first and second arms, wherein the second gap is larger than the width of the top edge of the perimeter wall and wherein the first gap is smaller than the width of the top edge of the perimeter wall, wherein the first and second arms are non-metallic and wherein the first and second arms have a symmetrical shape;

placing the first arm adjacent to the inner wall portion of the perimeter wall and placing the second arm adjacent to the outer wall portion of the perimeter wall, wherein the top edge of the perimeter wall is between the first arm and the second arm;

releasing the first arm and the second arm to maintain a pinching force on the perimeter wall; and, closing the lid onto the ventilation apparatus, so as to maintain a ventilation space between the lid and the perimeter wall, allowing evaporation of the interior moisture through the ventilation space.

2. The method of claim 1, wherein the ventilation apparatus is tethered to the cooler.

3. The method of claim 1, wherein the first arm includes a first grip foot and the second arm includes a second grip foot, and wherein the first foot engages the inner wall portion of the perimeter wall and the second foot engages the outer wall portion of the perimeter wall in conjunction with maintaining the pinching force.

4. The method of claim 3, wherein the first gap and second gap are defined by the spacing between the first grip foot and the second grip foot.

5. The method of claim 3, wherein the first grip foot and the second grip foot are made of a non-metallic material.

6. A method of ventilating a cooler having interior moisture, the cooler including a plurality of perimeter walls, each of which has an inner wall portion, an outer wall portion and a top edge, said method comprising:

storing a ventilation apparatus in one of the plurality of perimeter walls of the cooler, such that the ventilation apparatus is stored entirely between a first plane which includes the inner wall portion, a second plane which includes the outer wall portion and a third plane which includes the top edge;

opening a lid of said cooler;

arranging the ventilation apparatus such that at least a portion of the ventilation apparatus is between the lid and the top edge of one of the plurality of perimeter walls of the cooler; and, closing the lid onto the ventilation apparatus, so as to maintain a ventilation space between the lid and the perimeter wall, allowing evaporation of the interior moisture through the ventilation space, wherein the step of arranging includes:

stretching first and second elastically yielding arms of the ventilation apparatus from a first position to a second position, wherein the first position defines a first gap between the first and second arms and the second position defines a second gap between the first and second arms, wherein the second gap is larger than a width of the top edge of one of the plurality of perimeter walls and wherein the first gap is smaller than the width of one of the plurality of perimeter walls;

placing the first arm adjacent to the inner wall portion of one of the plurality of perimeter walls and placing the second arm adjacent to the outer wall portion of one of the plurality of perimeter walls, wherein the top edge of one of the plurality of perimeter walls is between the first arm and the second arm;

releasing the first arm and the second arm to maintain a pinching force on one of the plurality of perimeter walls.

7. A method of ventilating a cooler having interior moisture, the cooler including a perimeter wall having an inner wall portion, an outer wall portion and a top edge, wherein the top edge has a width and wherein a cavity is maintained at a vacuum state between the inner wall portion and the outer wall portion of the perimeter wall to provide insulation, the cooler also including a lid, said method comprising:

opening the lid of the cooler;

stretching first and second elastically yielding arms of a ventilation apparatus from a first position to a second position, wherein the first position defines a first gap between the first and second arms and the second position defines a second gap between the first and second arms, wherein the second gap is larger than the width of the top edge of the perimeter wall and wherein the first gap is smaller than the width of the top edge of the perimeter wall, wherein the first and second arms have a symmetrical shape;

placing the first arm adjacent to the inner wall portion of the perimeter wall and placing the second arm adjacent to the outer wall portion of the perimeter wall, wherein the top edge of the perimeter wall is between the first arm and the second arm;

releasing the first arm and the second arm to maintain a pinching force on the perimeter wall; and, closing the lid onto the ventilation apparatus, so as to maintain a ventilation space between the lid and the perimeter wall, allowing evaporation of the interior moisture through the ventilation space.

8. The method of claim 7, wherein the first and second arms are non-metallic.

9. The method of claim 8, wherein the ventilation apparatus is tethered to the cooler.

10. The method of claim 8, wherein the first arm includes a first grip foot and the second arm includes a second grip foot, and wherein the first foot engages the inner wall portion of the perimeter wall and the second foot engages the outer wall portion of the perimeter wall in conjunction with maintaining the pinching force.

11. The method of claim 10, wherein the first gap and second gap are defined by the spacing between the first grip foot and the second grip foot.

12. A method of ventilating a cooler having interior moisture, the cooler including a plurality of perimeter walls, each of which has an inner wall portion, an outer wall portion and a top edge, said method comprising:

storing a ventilation apparatus in one of the plurality of perimeter walls of the cooler, such that the ventilation apparatus is stored entirely between a first plane which includes the inner wall portion, a second plane which includes the outer wall portion and a third plane which includes the top edge, wherein a cavity is maintained at a vacuum state between the inner wall portion and the outer wall portion of one of the perimeter walls to provide insulation;

opening a lid of said cooler;

arranging the ventilation apparatus such that at least a portion of the ventilation apparatus is between the lid and the top edge of one of the plurality of perimeter walls of the cooler; and, closing the lid onto the ventilation apparatus, so as to maintain a ventilation space between the lid and the top edge of one of the perimeter walls, allowing evaporation of the interior moisture through the ventilation space, wherein the step of arranging includes:

stretching first and second elastically yielding arms of the ventilation apparatus from a first position to a second position, wherein the first position defines a first gap between the first and second arms and the second position defines a second gap between the first and second arms, wherein the second gap is larger than a width of the top edge of one of the plurality of perimeter walls and wherein the first gap is smaller than the width of one of the plurality of perimeter walls;

placing the first arm adjacent to the inner wall portion of one of the plurality of perimeter walls and placing the second arm adjacent to the outer wall portion of one of the plurality of perimeter walls, wherein the top edge of one of the plurality of perimeter walls is between the first arm and the second arm;

releasing the first arm and the second arm to maintain a pinching force on one of the plurality of perimeter walls.

* * * * *